United States Patent [19]

Takano et al.

[11] Patent Number: 4,459,723

[45] Date of Patent: Jul. 17, 1984

[54] SLIDE FASTENER STRINGER AND METHOD AND DEVICE FOR FORMING AN END THEREOF

[75] Inventors: Shinji Takano, Kurobe; Yoshiyuki Horita, Toyama, both of Japan

[73] Assignee: Yoshida Kogyo K. K., Tokyo, Japan

[21] Appl. No.: 375,455

[22] Filed: May 6, 1982

[30] Foreign Application Priority Data

May 7, 1981 [JP] Japan ..... 56-67695

[51] Int. Cl.[3] ..... A44B 19/36

[52] U.S. Cl. ..... 24/434; 264/319; 24/433

[58] Field of Search ..... 24/205.11 R, 205.11 K, 24/205; 269/319

[56] References Cited

U.S. PATENT DOCUMENTS

| | | | |
|---|---|---|---|
| 3,333,305 | 8/1967 | Taylor | 24/205.11 |
| 3,485,691 | 12/1969 | Waldes | 24/205.11 F X |
| 3,972,095 | 8/1976 | Kandou | 24/205.11 F |
| 4,182,006 | 1/1980 | Yoshida | 24/205.11 F |
| 4,254,539 | 3/1981 | Yoshida | 24/205.11 F |
| 4,267,621 | 5/1981 | Akashi | 24/205.11 R |

FOREIGN PATENT DOCUMENTS

| | | | |
|---|---|---|---|
| 2733532 | 2/1978 | Fed. Rep. of Germany | 24/205.11 R |

*Primary Examiner*—William E. Lyddane

*Assistant Examiner*—Peter A. Aschenbrenner

*Attorney, Agent, or Firm*—Hill, Van Santen, Steadman & Simpson

[57] ABSTRACT

A slide fastener stringer includes a row of helically coiled or zig-zag coupling elements of thermoplastic synthetic resin with a reinforcing core extending longitudinally therethrough. The coupling elements are secured to one surface of a stringer tape by sewing threads having portions running across and over upper legs of the coupling elements. Some of the coupling elements are cut off to provide an element-free space on the stringer tape. A terminal or endmost complete coupling element disposed adjacent to the element-free space has a free-ended connecting portion remote from a longitudinal edge of the stringer tape. To form an end of the slide fastener stringer, the free-ended connecting end portion of the terminal coupling element is fused to the stringer tape, and at the same time, the upper leg of the terminal coupling element is heated and pressed toward the stringer tape. A device for forming such a stringer end includes a stringer rest for supporting the end of the stringer, and a heating presser having a first surface for heating and pressing the free-ended connecting portion of the terminal coupling element against the stringer tape and a second surface for heating and pressing the upper leg of the terminal coupling element toward the stringer tape. The first surface projects beyond the second surface toward the stringer rest.

10 Claims, 10 Drawing Figures

SLIDE FASTENER STRINGER AND METHOD AND DEVICE FOR FORMING AN END THEREOF

BACKGROUND OF THE INVENTION

1. Field of the Invention

The present invention relates to a slide fastener stringer having a stringer tape and a row of helically coiled or zig-zag coupling elements of thermoplastic synthetic resin sewn to the stringer tape along a longitudinal edge thereof and a method and device for forming an end of such a slide fastener stringer.

2. Prior Art

One known method of manufacturing separable slide fasteners is disclosed in U.S. Pat. No. 3,333,305 patented Aug. 1, 1967. According to the disclosed method, some helically coiled or zig-zag coupling elements, having a reinforcing core extending therethrough and sewn to a stringer tape, are removed to provide an element-free space on the stringer tape at an end thereof. Then, a fragmentary portion of a terminal or endmost coupling element namely its sewn lower leg, disposed adjacent to the element-free space is fused to the stringer tape with heat and pressure, and a separable bottom stop member is affixed to the stringer tape at the element-free space.

With the prior arrangement, the upper leg of the terminal or endmost complete coupling element tends to stick out when the leg is positioned by a presser for fusing the free lower leg portion and also when subjected to forces tending to push up the terminal coupling element upon the free lower leg portion's portion being pressed and heated by the presser. The upper leg of the terminal coupling element will also be forced out when a separable bottom stop member is mounted on the stringer tape at the element-free space under pressure in sandwiching relation to the stringer tape. Such a displacement of the upper leg of the terminal or endmost coupling element causes a coupling head thereof to move toward an adjacent coupling element, resulting in irregular spacings or pitches between adjacent coupling heads. When two such slide fastener stringers are to be taken by a slider into or out of interdigitating engagement with each other, the slider tends to stick or becomes sluggish in motion in getting the irregularly spaced coupling elements interengaged or disengaged from each other.

SUMMARY OF THE INVENTION

A terminal or endmost coupling element or thermoplastic synthetic resin sewn to a stringer tape has a cut turn or endmost fragmentary portion fused to the stringer tape with heat and pressure, and an upper leg heated and pressed toward the stringer tape. A separable bottom stop member is attached to an element-free portion of the tape adjacent to the terminal coupling element in sandwiching relation to the stringer tape. A device for forming such an end of a slide fastener stringer includes a stringer rest for supporting the slide fastener stringer, and a heating presser including a first surface for pressing with heat the free-ended connecting portion against the stringer tape on the stringer rest and a second surface for heating and pressing the upper leg of the terminal or endmost coupling element, except portions of sewing threads thereon, toward the stringer tape.

It is an object of the present invention to provide a slide fastener stringer having a terminal coupling element fixed in position for allowing a slider to slide smoothly thereover.

Another object of the present invention is to provide a method of forming an end of a slide fastener stringer with a terminal coupling element fixed in position and a free-ended connecting portion fused to a stringer tape.

Another object of the present invention is to provide a device for reducing such a method to practice.

Many other advantages, features and additional objects of the present invention will become manifest to those versed in the art upon making reference to the detailed description and the accompanying sheets of the drawings in which a preferred embodiment incorporating the principles of the present invention is shown by way of illustrative example.

DETAILED DESCRIPTION

Figure 1:
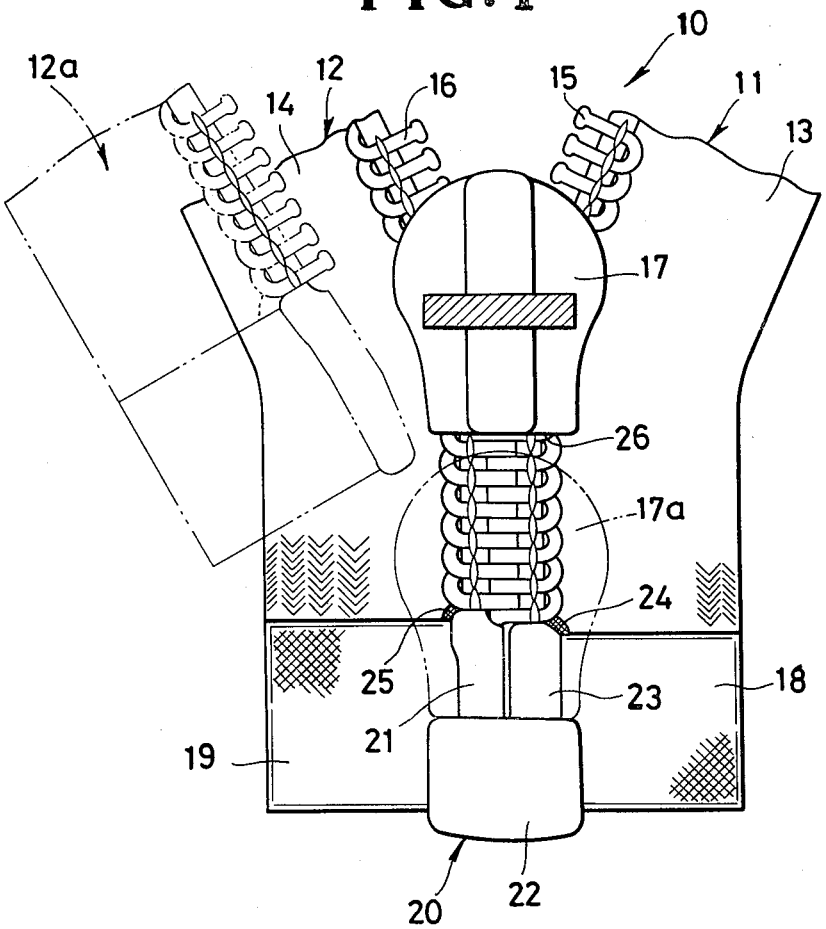
FIG. 1 is a fragmentary plan view of a slide fastener having a separable bottom stop comprising a box and a pin insertable therein.

As shown in FIG. 1, a separable slide fastener 10 of the present invention comprises a pair of slide fastener stringers 11, 12 including a pair of stringer tapes 13, 14, respectively, which support a pair of rows of helically coiled coupling elements 15, 16 on and along inner longitudinal edges of the stringer tapes 13, 14, respectively. The coupling elements 15, 16 are made of thermoplastic synthetic resin. A slider 17 is slidably mounted on the rows of coupling elements 15, 16 to take the latter into and out of interdigitating engagement with each other. The stringer tapes 13, 14 include at ends thereof a pair of reinforcement films 18, 19, respectively, bonded thereto.

A separable bottom stop 20 comprises a pin 21 mounted on the stringer tape 14 at its end to which the reinforcement film 19 is attached and extending along the inner longitudinal edge of the stringer tape 14. The separable bottom stop 20 also has a box 22 and a box pin 23 integral therewith and mounted on the stringer tape 13 and the reinforcement film 18 attached thereto, the box pin 23 extending along the inner longitudinal edge of the stringer tape 13. The pin 21 is insertable into the box 22 to couple the stringer tapes 13, 14 at their lower ends. The rows of coupling elements 15, 16 include terminal or endmost free-ended connecting portions 24, 25 (described later in detail) which are fused to the stringer tapes 13, 14, respectively, and embedded in the pin 21 and the box pin 23, respectively. To separate the stringers 11, 12, the slider 17 is brought down to the position shown by the two-dot-and-dash line 17*a* with a lower end 26 of the slider 17 being held against the box 22 to thereby uncouple the coupling elements 15, 16 all the way, and then one of the stringers 12 is removed to the position shown by the two-dot-and-dash lines 12*a* thereby pulling the pin 21 out of the box 22 through the slider 17. The stringers 11, 12 may be coupled together by bringing the pin 21 back into the box 22 and moving the slider 17 away from the box 22.

Figure 2:
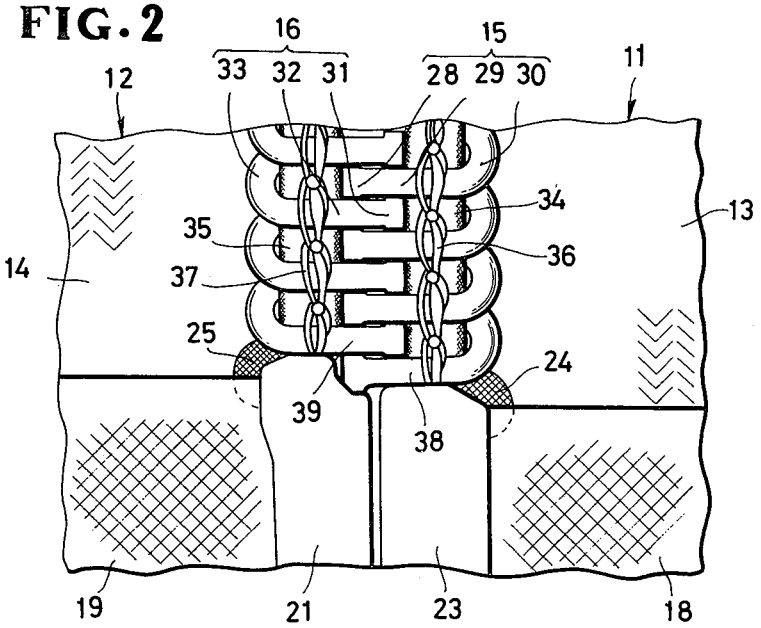
FIG. 2 is a fragmentary plan view of the slide fastener shown in FIG. 1, illustrating the separable bottom stop and adjacent coupling elements pressed and heated according to a method of the present invention.
Figure 3:
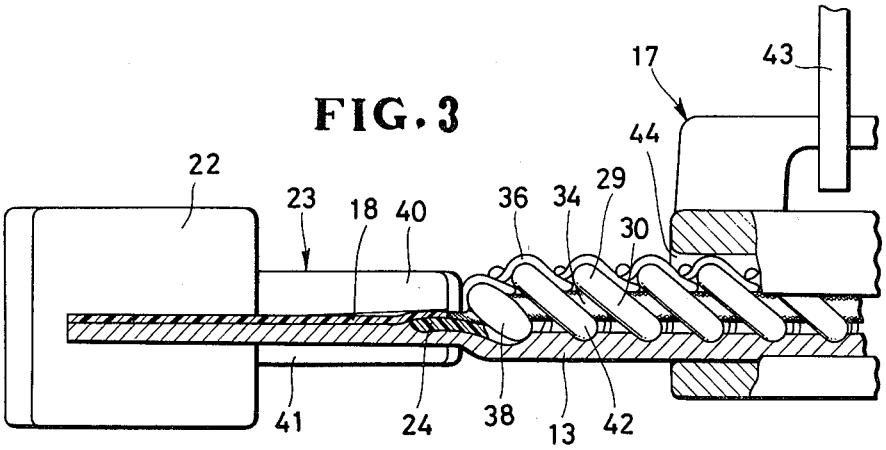
FIG. 3 is a side elevational view, partly in cross section, of the slide fastener of FIG. 2 with a slider.
Figure 4:
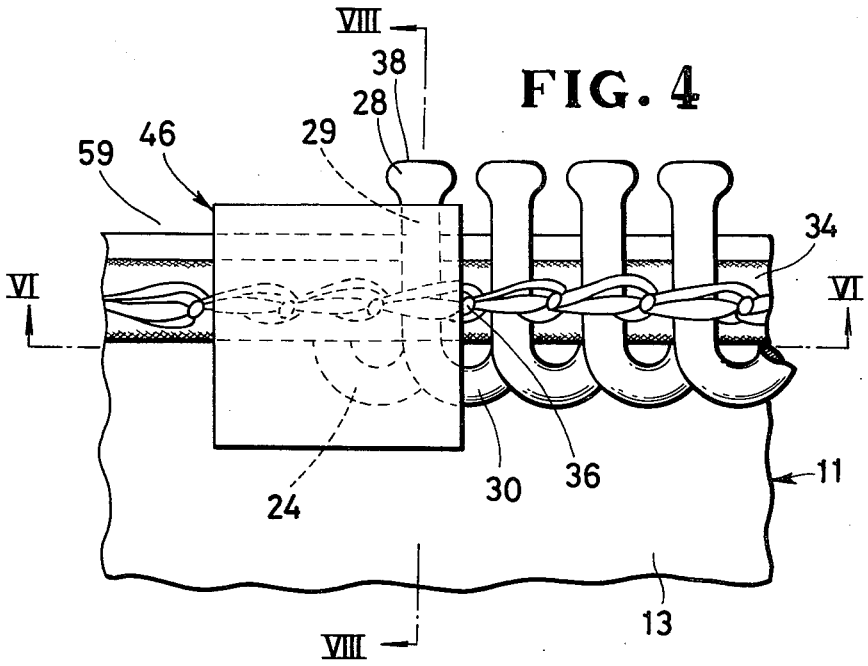
FIG. 4 is a fragmentary plan view of a slide fastener stringer and a heating presser placed thereon for pressing heating a portion of the slide fastener stringer.

As illustrated in FIGS. 2 and 3, each of the coupling elements 15 on the stringer tape 13 includes a coupling head 28 extending beyond the inner longitudinal edge of the stringer tape 13, a pair of upper and lower legs 29, 42 mounted on the inner longitudinal edge of the stringer tape 3 and extending transversely of the stringer tape 13, and a connecting portion 30 joined to an adjacent coupling element 15. A reinforcing core 34 extends longitudinally through the coupling elements 15 and is disposed between the upper and lower legs 29, 42 and adjacent to the connecting portions 30. The complete coupling elements 15 are sewn to the stringer tape 13 by sewing threads 36 passing through the reinforcing core 34 and the stringer tape 13 and having portions running across and over the upper legs 29 of the coupling elements. Likewise, each of the coupling elements 16 on the stringer tape 14 includes a coupling head 31, an upper leg 32, a lower leg (not shown), and a connecting portion 33. A reinforcing core 35 extends longitudinally through the coupling elements 16. The complete coupling elements 16 are secured to the stringer tape 14 by sewing threads 37.

The rows of coupling elements 15, 16 include a pair of terminal or endmost coupling elements 38, 39, respectively, which are positioned near the box pin 23 and the pin 21, respectively. The connecting portions 30, 33 of the endmost coupling elements 38, 39 are hereinafter referred to as connecting portions 24, 25, but as the adjacent coupling element has been entirely removed, the so-called connecting portions each have a free-end terminating where the leg of the adjacent coupling element had been severed. The free-ended connecting portions 24, 25 extend respectively from the lower legs of the terminal coupling elements 38, 39. The free-ended connecting portions 24, 25 are left on the stringer tapes 13, 14, respectively, when several coupling elements are cut off and removed to provide an element-free portion or space 59 (FIGS. 4, 6, 7, 9 and 10) below the terminal or endmost coupling elements 38, 39. As best shown in FIG. 3, the terminal coupling element 38 is depressed toward the stringer tape 13 so that its upper leg is lower than the upper legs of the other coupling elements 15. The terminal coupling element 39 on the stringer tape 14 is similarly deformed.

The box pin 23 is composed of upper and lower plates 40,41, as shown in FIG. 3, which are pressed toward each other in sandwiching relation to the stringer tape 13, the reinforcing film 18 and the free-ended connecting portion 24. As assembled, the upper plate 40 is fixed to the reinforcing film 18 and the lower plate 41 is fixed to the stringer tape 13. The pin 21 on the opposite stringer 12 is similarly fixed to the stringer tape 14 and the reinforcing film 19.

Figure 5:
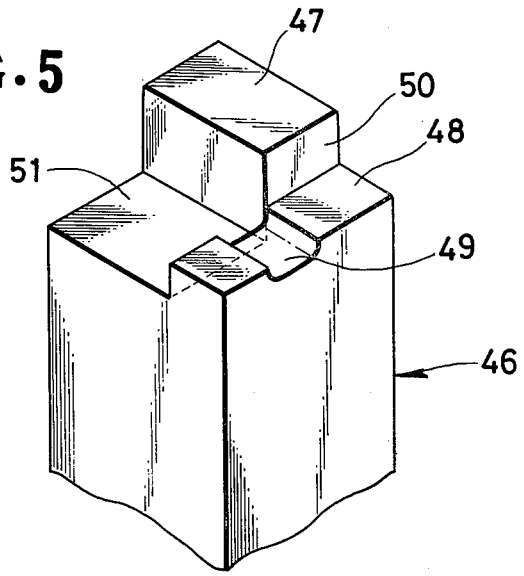
FIG. 5 is a fragmentary perspective view of the heating presser shown in FIG. 4, the heating presser being part of a device for forming an end of a slide fastener stringer according to the present invention.
Figure 6:
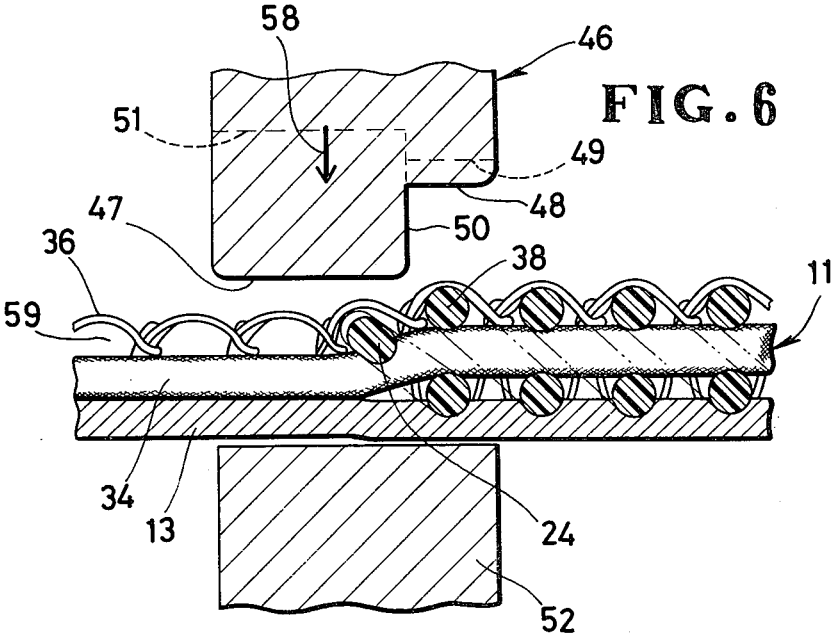
FIG. 6 is a longitudinal cross-sectional view taken along line VI—VI of FIG. 4, showing a stringer rest positioned in vertical alignment with the heating presser.
Figure 8:
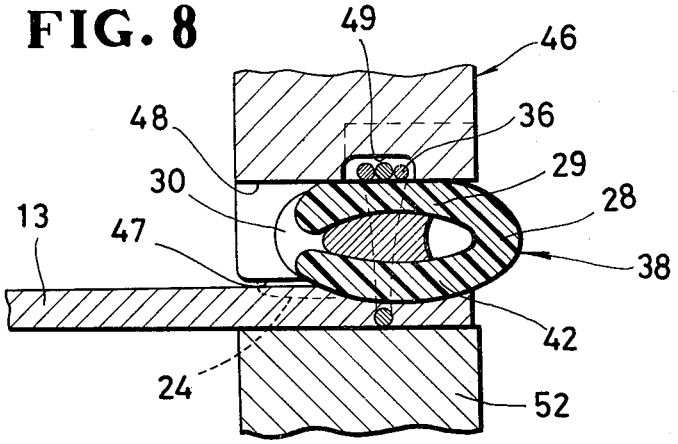
FIG. 8 is a transverse cross-sectional view taken along line VIII—VIII of FIG. 4.

As shown in FIG. 6, a device for forming such an end of a slide fastener stringer comprises a stationary stringer rest 52 and a heating presser 46 held in vertical alignment with and movable toward the stringer rest 52. As illustrated in FIG. 5, the heating presser 46 includes a first surface 47, a second surface 48 lower than the first surface 47 and having a recess 49, a positioning surface 50 lying between the first and second surfaces 47,48 in perpendicular relation thereto, and a third surface 51 lower than the second surface 48. When the heating presser 46 is disposed in confronting relation to the stringer rest 52, the first surface 47 thus projects beyond the second surface 48 toward the stringer rest 52 as illustrated in FIG. 6. As best shown in FIG. 8, the second surface 48 serves to press the upper leg 29 of the terminal coupling element 38 toward the stringer tape 13, and the first surface 47 serves to press the free-ended connecting portion 24 into the stringer tape 13. During operation, the heating presser 46 may be heated electrically, ultrasonically or in any other conventional manner.

Figure 9:
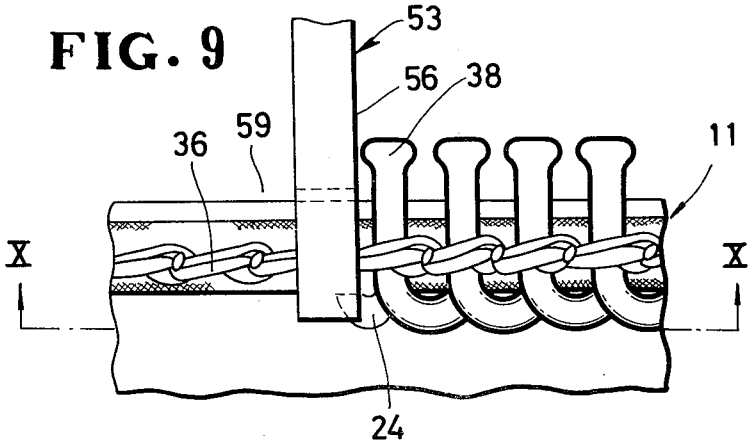
FIG. 9 is a fragmentary plan view of a slide fastener stringer having at an end thereof a terminal coupling element as it is positioned by a stop.
Figure 10:
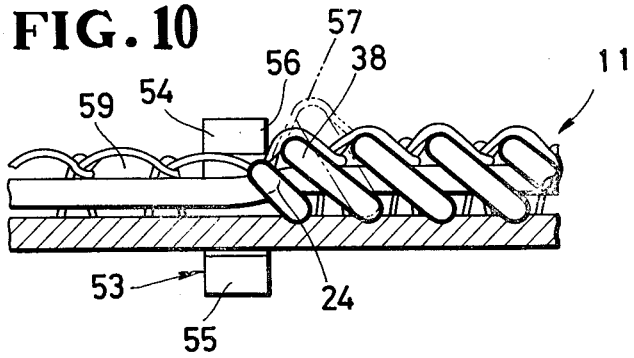
FIG. 10 is a longitudinal cross-sectional view taken along line X—X of FIG. 9.

FIGS. 9 and 10 show a stopper 53 for stopping the slide fastener stringer 11 as it is fed longitudinally from a previous station in which the slide fastener stringer 11 is gapped to provide the element-free space 59. The stopper 53 includes a pair of upper and lower arms 54,55 for passage therebetween of the stringer tape 13, and a stop surface 56 engageable with the terminal coupling element 38 to stop the slide fastener stringer 11.

In operation, the slide fastener stringer 11 is stopped in its longitudinal movement upon abutting engagement of the stopper 53 with the terminal coupling element 38. At this time, the upper leg 29 of the terminal coupling element 38 is displaced upwardly to the position shown by the two-dot-and-dash lines 57 in FIG. 10. Then, the stopper 53 is retracted out of the path of movement of the slide fastener stringer 11. The slide fastener stringer 11 is now placed on the stringer rest 52 with the free-ended connecting portion 24 and the upper leg 29 of the terminal coupling element 38 being located below the first and second surfaces 47,48, of the heating presser, respectively.

Figure 7:
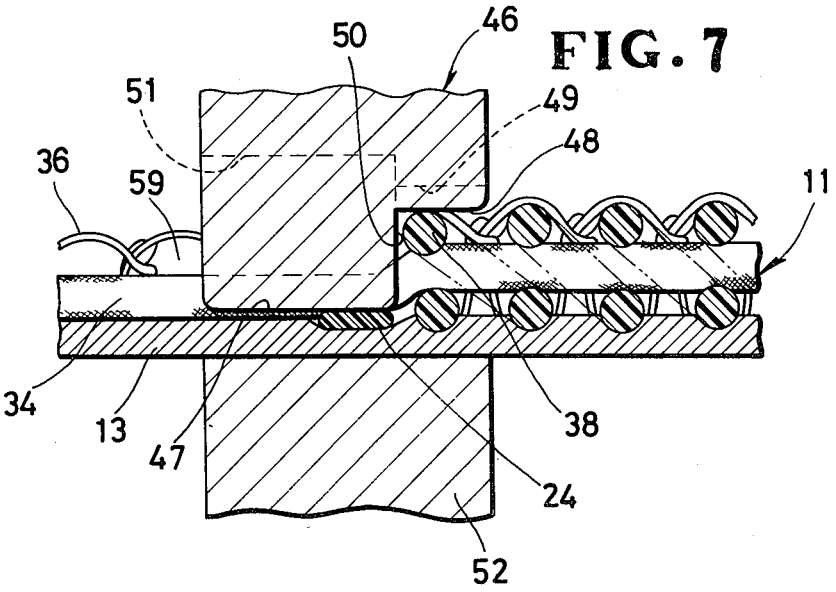
FIG. 7 is a view similar to FIG. 6, illustrating the heating presser as coacting with the stringer rest to form an end of the slide fastener stringer.

When the heated presser 46 is moved downwardly toward the stringer rest 52 in the direction of the arrow 58 (FIG. 6), the first surface 47 presses and heats the free-ended connecting portion 24 and fuses the latter to the stringer tape 13, and the second surface 48 presses and heats the upper leg 29 of the terminal coupling element 38 to heat-set the pressed upper leg 29 for positionally fixing the latter with respect to the stringer tape 13, as shown in FIG. 7. The free-ended connecting portion 24 as fused is flattened down against the stringer tape 13. The upper leg 29 of the terminal coupling element 38 is simultaneously positioned in place by the positioning surface 50 such that it is displaced to tilt down toward the fused free-ended connecting portion 24, and hence lies in a plane lower than a plane of the upper legs 29 of the other coupling elements 15. As shown in FIG. 8, the portions of the sewing threads 36 positioned on the upper leg 29 of the terminal coupling element 38 are received in the recess 49 in the second surface 48 without being directly heated and pressed by the second surface 48. Thus, the sewing threads 36 on the terminal coupling element 38 retain a required degree of flexibility and strength.

The upper leg 29 of the terminal coupling element 38 will latter be raised or returned into a level substantially the same as or slightly lower than that of the upper legs 29 of the other coupling elements 15 when the stringer tape 13 and the reinforcing core 34 are forcibly sandwiched between the upper and lower plates 40, 41 of the box pin 23 and squeezed thereby toward the terminal coupling element 38.

The terminal coupling element 39 and the free-ended connecting portion 25 on the stringer tape 14 are similarly pressed and heated until they are positionally fixed and fused with respect to the stringer tape 14. For forming the end of the slide fastener stringer 12, however, a heating presser is used which is similar to the heating presser 46, but is of a symmetrical configuration.

With the method and device according to the present invention, the terminal coupling elements 38,39 adjacent to the separable bottom stop 20 remain substantially the same in shape and pitch as the other continuous coupling elements, allowing the opposite slide fastener stringers 11,12 to interengage smoothly upon sliding movement of the slider 17 therealong.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A slide fastener stringer comprising:

(a) a stringer tape; and (b) a row of continuous helically coiled coupling elements of thermoplastic synthetic resin mounted on and along a longitudinal edge of said stringer tape, each said coupling element including a coupling head extending beyond said longitudinal edge, a pair of upper and lower legs mounted on said longitudinal edge and extending from said coupling head in a common direction, and a connecting portion joined to one of said legs of an adjacent coupling element remotely from said coupling head, said coupling elements including an endmost complete coupling element located at an end of the slide fastener stringer, its said connecting portion extending angularly from said lower leg of said endmost coupling element and terminating in a free end disposed remotely from said longitudinal edge of said stringer tape and fused to said stringer tape, said stringer tape having an element-free portion adjacent to said endmost complete coupling element, said upper leg of said endmost complete coupling element being lower than the upper legs of the other coupling elements.

2. A slide fastener stringer according to claim 1, said upper leg of said terminal coupling element tilting down toward said free-ended connecting portion.

3. A slide fastener stringer according to claim 1, said row of coupling elements being secured to said stringer tape by sewing threads.

4. A slide fastener stringer according to claim 1, including a reinforcing core extending longitudinally through said row of coupling elements.

5. A method of forming an end of a slide fastener stringer having a stringer tape, and a row of continuous helically coiled coupling elements of thermoplastic synthetic resin mounted on and along a longitudinal edge of the stringer tape, each of the coupling elements including a coupling head extending beyond the longitudinal edge, a pair of upper and lower legs mounted on the longitudinal edge and extending from the coupling head in a common direction, and a connecting portion joined to one of said legs of an adjacent coupling element remotely from the coupling head, said connecting portion of the endmost complete coupling element extending angularly from the lower leg of said endmost coupling element, and having a free-end disposed remotely from said longitudinal edge of the stringer tape, said stringer tape having an element-free portion adjacent to said endmost complete coupling element, said method comprising the steps of:

(a) fusing the free-ended connecting portion to the stringer tape with heat and pressure; and (b) simultaneously, pressing and heating said upper leg of the endmost complete coupling element to fix the latter positionally with respect to the stringer tape.

6. A method according to claim 5, including the step of attaching a stop member to said element-free portion of the stringer tape under pressure in sandwiching relation to the stringer tape.

7. A device for forming an end of a slide fastener stringer having a stringer tape, a row of continuous helically coiled coupling elements of thermoplastic synthetic resin, and sewing threads attaching the coupling elements to one surface of the stringer tape along a longitudinal edge thereof and having portions running across and over upper legs of the coupling elements, the coupling elements including an endmost complete coupling element located at the end of the slide fastener stringer, and having a free-ended connecting portion extending angularly from a lower leg of the endmost complete coupling element and disposed remotely from the longitudinal edge of the stringer tape, the stringer tape having an element-free portion adjacent to the endmost complete coupling element, said device comprising:

(a) a stringer rest for supporting thereon the end of the slide fastener stringer; and (b) a heating presser movable toward said stringer rest and including a first surface for pressing and heating said free-ended connecting portion against the stringer tape and a second surface for pressing and heating the upper leg of the endmost complete coupling element, except said portions of the sewing threads thereon, toward said stringer tape.

8. A device according to claim 7, said second surface having a recess receptive therein of said portions of the sewing threads.

9. A device according to claim 7, said first surface projecting beyond said second surface toward said stringer rest.

10. A device according to claim 9, including a positioning surface lying between said first and second surfaces in perpendicular relation thereto for limiting the position of said upper leg of said terminal coupling element.

* * * * *